US005861902A

United States Patent [19]

Beerling

[11] Patent Number: 5,861,902

[45] Date of Patent: Jan. 19, 1999

[54] THERMAL TAILORING FOR INK JET PRINTHEADS

[75] Inventor: Timothy E. Beerling, Corvallis, Oreg.

[73] Assignee: Hewlett-Packard Company, Palo Alto, Calif.

[21] Appl. No.: 639,021

[22] Filed: Apr. 24, 1996

[51] Int. Cl.[6] ..... B41J 2/05

[52] U.S. Cl. ..... 347/63; 347/18; 347/205

[58] Field of Search ..... 347/63, 64, 62, 347/18, 205, 202

[56] References Cited

U.S. PATENT DOCUMENTS

| | | | |
|---|---|---|---|
| 3,973,106 | 8/1976 | Ura . | |
| 4,513,298 | 4/1985 | Scheu | 347/64 |
| 4,528,574 | 7/1985 | Boyden | 347/63 |
| 4,947,193 | 8/1990 | Deshpande | 347/62 |
| 5,257,042 | 10/1993 | Buhler | 347/64 |
| 5,751,315 | 5/1998 | Burke | 347/63 |

FOREIGN PATENT DOCUMENTS

| | | | |
|---|---|---|---|
| 61-254362 | 11/1986 | Japan | B41J 3/21 |
| 61-283573 | 12/1986 | Japan | B41J 3/21 |
| 63-307965 | 12/1988 | Japan | B41J 3/20 |
| 1-122442 | 5/1989 | Japan | B41J 3/04 |
| 1-225567 | 9/1989 | Japan | B41J 3/20 |

OTHER PUBLICATIONS

Capacitive Humidity Sensor With Controlled Performances, Based On Porous A1203 Thin Film Grown On SiO2–Si substrate, G Sberveglieir et al, Elsevie Sequoia, 1994, pp. 551–553.

Development Of Aluminum Gate Thin–Film Transistors Based On Aluminum Oxide Insulators, Toshihisa Tsukada, Mat. Res. Soc. Symp. Proc., vol. 284, 1993, pp. 371–382.

Development Of Thin–Film Structure For The ThinkJet Printhead, Eldurkar V. Bhaskar et al, Hewlett–Packard Journal, May, 1985, pp. 27–33.

Fabrication Of A One–Dimensional Microhole Array By Anodic Oxidation Of Aluminum, Hideki Masuda et al, American Institute Of Physics, Appl. Phys. Lett. 63, Dec. 6, 1993, pp. 3155–3157. . Bomchil et al, Elsevier Science Publishers B.V., 1993, pp. 394–407.

Microstructural Investigations Of Light–Emitting Porous Si Layers, T. George et al, American Institute Of Physics, Appl. Phys. Lett. 60, May 11, 1992, pp. 2359–2361.

Porous Silicon: Material Properties, Visible Photo–and Electroluminescence, G. Bomchil et al, Elsvier Science Publisher B. V., 1993, pp. 394–407.

Thermodynamics And Hydrodynamics of Thermal Ink Jets, Ross R. Allen et al, Hewlett–Packard Journal, May 1985, pp. 21–27.

*Primary Examiner*—Joseph W. Hartary
*Attorney, Agent, or Firm*—Kevin B. Sullivan

[57] ABSTRACT

The present invention is a thermal printhead which includes a substrate portion, a resistive material configured to form a heating element and a thermal barrier island positioned between the resistive material and the substrate portion. The thermal barrier island is defined between the heating element and the substrate portion to reduce the heat flow between the heating element and the substrate portion.

6 Claims, 8 Drawing Sheets

THERMAL TAILORING FOR INK JET PRINTHEADS

The present invention relates to printheads for thermal ink jet printers. More particularly, the present invention relates to a method and apparatus for tailoring underlayers of a thermal printhead to reduce the turn on energy while maintaining high firing frequencies.

Ink jet printing involves forming output images by printing a pattern of individual dots at particular locations on the print medium. The locations are conveniently visualized as being small dots in a rectilinear array. The locations are sometimes called "dot locations", "dot positions", or picture elements sometimes referred to as "pixels". Thus, the printing operation can be viewed as the selective filling an array of dot locations with droplets of ink. Each dot location within the array is usually filled by a single droplet of ink.

The printhead used in thermal ink jet printers typically includes a nozzle plate having an array of ink ejecting nozzles, a plurality of ink firing chambers adjacent respective nozzles, and a plurality of heater resistors adjacent the firing chambers opposite the ink ejecting nozzles and spaced therefrom by the respective firing chamber. Each heater resistor causes an ink drop to be fired from its associated nozzle in response to a electrical impulse of sufficient energy. Also associated with the printhead is usually some means for providing backpressure to prevent ink from leaking from the nozzle plate when the printer is bumped or during changes in atmospheric pressure. The printhead also includes an ink supply for providing ink to the firing chambers to replenish the chambers after ink is ejected.

A minimum energy is usually required to fire ink drops of the proper volume from the thermal ink jet printhead. This minimum energy is referred to as the "turn on energy". The turn on energy must be sufficient to locally superheat ink within the printhead to achieve reliable and repeatable vaporization sometimes referred to as bubble formation. The turn on energy in general will be different for different printhead designs. In addition, because of manufacturing tolerances the turn on energy for a given design may vary from printhead to printhead.

Previously used printheads such as disclosed in U.S. Pat. No. 4,528,574 entitled "Thermal Ink Jet Printhead" to Scheu, assigned to the assignee of the present invention and incorporated herein by reference, include a substrate having a uniform silicon dioxide thermal insulating barrier formed on the substrate. A resistive heating element is then formed on the silicon dioxide thermal insulating barrier. A protective passivation layer is formed over the resistive heating element. The silicon dioxide insulating barrier is selected to be thick enough to insulate the heater from the substrate from the heating element when the heater is active. Printhead cooling is achieved by the transfer of heat from the substrate to the ink which is then ejected from the printhead. The use of a uniform silicon dioxide insulating layer to provide low turn on energies tends to prevent or limit heat flow from the printhead to the substrate. Because heatflow from the printhead to the substrate is limited or reduced operation at high print frequencies tends to result in high steady state printhead temperatures.

High steady state printhead temperatures tend to produce thermally induced stresses on the printhead as well as surrounding structures such as a flexible circuit which is often used to provide electrical energy to the printhead. Higher temperatures and thermally induced stresses tends to delaminate these flexible circuits reducing the reliability and useful life of the printer.

There is an ever present need for printheads that exhibit long life and are capable of providing good print quality throughout the life of the printhead. In addition, these printheads should be capable of operating at lower turn on energies while providing higher print frequency thereby allowing the printer to provide higher throughput for a given steady state printhead operating temperature.

SUMMARY OF THE INVENTION

The present invention is a printhead for use in thermal ink jet printing. The printhead includes a substrate portion, a resistive material configured to form a resistive heating element. Also included is a thermal barrier island defined between the resistive material and the substrate portion for controlling heat flow between the resistive material and the substrate portion.

In one preferred embodiment the barrier island is a region of low thermal diffusivity relative to a thermal diffusivity associated with adjacent regions. In one preferred embodiment the barrier island is a porous material. In another embodiment the barrier island is defined in a layer disposed between the substrate portion and the resistive material. In one preferred embodiment the barrier island is defined within a substrate layer which includes the substrate portion. In one embodiment the barrier island is formed from anodized alumina. In yet another preferred embodiment the barrier island is formed from porous silicon.

In another preferred embodiment, the barrier island is a cavity. In this embodiment the cavity is defined by one or more layers positioned between the between the substrate portion and the resistive material. The cavity is preferably evacuated or filled with an inert gas at low pressure.

Another aspect of the present invention is a thermal printhead which includes a substrate portion, a resistive material configured to form a resistive heating element. Also included in the thermal printhead is a thermally tailored underlayer disposed between the resistive material and the substrate portion. The underlayer is tailored to provide low thermal diffusivity in a region adjacent the resistive heating element and a high thermal diffusivity in a region spaced from the resistive heating element for controlling heat flow between the resistive material and the substrate portion. In one embodiment the thermally tailored underlayer and the substrate portion are located, at least partially within a substrate layer. In one embodiment the underlayer includes a porous portion. In another embodiment the underlayer defines a cavity.

Yet another aspect of the present invention is a method for cooling a resistive heating element of a thermal ink jet printhead. The resistive heating element receives electrical energy during a heating period and converts this electrical energy into heat energy for ejecting ink from the printhead. The method includes blocking rapid heatflow relative to the heating period from the resistive heating element to the substrate. The method also includes allowing heatflow that is slow relative to the heating period from the resistive heating element to the substrate thereby cooling the resistive heating element.

DETAILED DESCRIPTION OF THE PREFERRED EMBODIMENT

Before discussing the thermal printhead of the present invention it will be helpful to first define some terms. As discussed previously, the operation of a thermal printhead involves the selective application of electrical energy to a heating element to produce heat energy for producing droplets of ink from the printhead orifice. The energy provided to the heater resistor is critical for producing ink drops of proper volume. At a nucleation threshold energy the heating element produces sufficient heat for nucleation whereby bubbles are formed in the ink. In this nucleation phase varying amounts of energy provided to the heating element can produce ink drops of different drop volume. For water-based inks, the temperature for bubble nucleation is around 280° Celsius. The turn on energy is defined be the minimum energy that produces an ink drop of a predetermined volume.

Drop frequency is the rate at which drops of predetermined volume are produced. There are several factors that effect the maximum rate of drop production or maximum drop frequency. One factor is the response of the fluid ink system. For example, in an underdamped system, fluid rushes back to the nozzle area so fast that the nozzle becomes overfilled creating a bulging meniscus. The ejection of ink droplets with the meniscus in a bulged condition causes the drop volume to increase in proportion to the severity of the bulge.

Another factor that can limit the rate of drop production is the ability to cool the printhead thereby causing the accumulation of heat resulting in overheating and damage to the printhead and or surrounding structures. Thermal ink jet printheads are cooled in part by heat conduction from the heating element to a substrate upon which the heating element is formed. Heat energy is removed from the printhead by the ejection of heated ink from the printhead. Assuming the printhead is designed such that there are no other limiting factors such as the response of the ink system then the maximum frequency for a given printhead design is based on the printheads ability to cool the heating element thereby preventing overheating and failure of the printhead and or surrounding structures.

Figure 1:
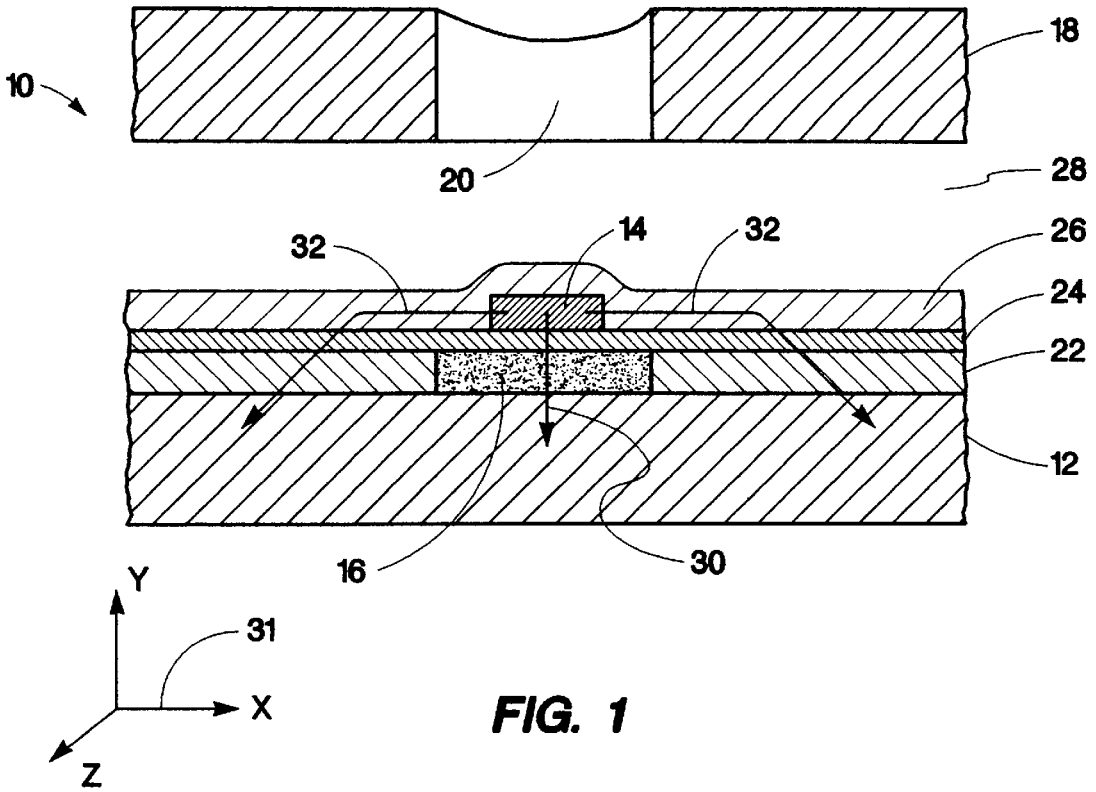
FIG. 1 is a representation of a thermal printhead of the present invention which makes use of a barrier island for thermal tailoring shown in crossection, partially broken away.

FIG. 1 shows the printhead 10 of the present invention shown in cross section, partially broken away. The printhead 10 of the present invention includes a substrate 12, a heating element 14 and a thermal barrier island 16 that is positioned between the heating element 14 and the substrate. 12. The printhead 10 also includes an orifice plate 18 having an orifice 20 from which ink drops are ejected.

In one embodiment the barrier island 16 is defined within one or more intermediate layers between the substrate 12 and the heating element 14. For example, the barrier island 16 may be defined in an intermediate layer 22. Alternatively, the barrier island may be formed separately, without the intermediate layer 22. A dielectric layer 24 is formed over the barrier layer 16 to electrically isolate the resistive heating element 14. A protective layer 26 is formed on top of the heating element 14 as well as the first dielectric layer 24. The protective layer 26 prevents ink which is provided by ink inlet 28 from chemically interacting with the heating element 14. In addition, the protective layer 26 protects the heating element 14 from cavitation stresses resulting from bubble collapse.

Electrical energy is provided to the heating element 14 by electrical conductors (not shown) to form heat energy. This heat energy if sufficient produces nucleation or bubble formation for expelling ink from the orifice 20 in the orifice plate 18. The heating element 14 is typically a strip or layer of resistive material having a thickness on the order of one thousand angstroms. Electrical conductors are defined on the resistive material to define the active portion or heating element 14.

The thermal barrier island 16 which is the subject of the present invention is positioned between the heating element 14 and the substrate 12. The thermal barrier island 16 is configured to greatly reduce or eliminate conductive heat flow from the heating element 14 directly to the substrate 12 represented by arrow 30. The heat flow path 30 represents conductive heat flow that is primarily in the vertical direction represented by a y-axis in coordinate system 31. The reduction of conductive heat flow from the heating element 14 to the substrate 12 reduces the energy which must be provided to the heating element 14 to produce ink droplets of proper volume. The turn on energy is reduced because the thermal barrier island 16 greatly reduces or inhibits heat flow through the barrier island 16 during the time period in which energy is applied to the heating element 14. The barrier island 16 at least in part defines a thermal path from the heating element 14 to the substrate 12. Preventing the loss of significant heat energy to the substrate during the heating period allows the heating element 14 to reach nucleation temperature faster and with less electrical energy.

A second heat flow path is shown by arrows 32. This heat flow path between the heating element 14 and the substrate 12 extends along the second dielectric layer 26 and then down through the first dielectric layer 24 and the intermediate layer 22 into the substrate 12 as represented by arrows 32. The thermal path 32 represents conductive heat flow that is both in the lateral direction represented by a x-axis and z-axis in coordinate system 31. Conductive heat flow in the lateral direction allows heat to flow around the thermal barrier 16 and then vertically toward the substrate 12. Another aspect of this invention is that the heat flow path 32 around the thermal barrier island is sufficient to maintain a relatively low steady state printhead temperature for a given firing frequency. Put differently, the thermal path 32 provides sufficient heat flow to operate the printhead at greater printing frequencies for a given steady state operating temperature. In a typical thermal ink jet printhead the electrical energy provided to the heating element 14 is such that the nucleation threshold is reached in the order of a few microseconds. Therefore, the application of energy is over a very short time duration. Because the time duration is short little heat energy is lost during the heating process in the less direct heat flow path 32 around the thermal barrier island 16.

The use of the thermal barrier island 16 of the present invention therefore prevents a significant amount of heat transfer in heat flow path 30 or 32 during the time period in which energy is applied to the heating element 14. Another aspect of the present invention is to provide a second heat flow path 32 which is capable of transferring a sufficient amount of heat between heating cycles to allow for higher printing frequencies and or lower steady state printhead temperatures. As a result, little heat is lost by way of either heat flow path 30 or 32 during the short time period which energy is applied to the heating element 14 allowing relatively low turn on energies. Typically the entire heating time is on the order of a few microseconds while the period between heating times is on the order of tens to hundreds of microseconds. During this relatively long period between heating times a significant amount of heat is transferred from the heating element 14 to the substrate 12 by way of heat flow path 32 around the barrier island 16. There will be some heat transfer through the barrier island 16 because there is not a perfect insulator. However, heat transfer through the barrier island 16 should be minimized.

Factors which effect the amount of heat transferred in heat flow paths 30 and 32 include both the thermal diffusivity of material within the thermal path, the temperature gradient as well as the path geometry such as the cross-sectional area of the material normal to the flow of heat energy. In a typical thermal ink jet printhead the heating element 14 is on the order of a thousand angstroms thick in the vertical direction. The typical protective layer 26 is a first protective layer of silicon nitride that is 0.5 microns in thickness and. a second protective layer of silicon carbide that is 0.25 microns in thickness and a third protective anticavitation layer of tantalum 0.6 microns in thickness . The resistive heating element 14 has a length and width in the lateral direction that is on the order of 50 micrometers square. Therefore, the surface area normal to the resistive heating element 14 is significantly greater in the vertical direction along thermal path 30 then in the lateral direction along thermal path 32. An important aspect of the present invention is the use of the thermal barrier island 16 to block or limit rapid heat flow in the most direct thermal path 30 to the substrate portion 12 while at the same time providing an indirect, thermal conduction path 32 around the thermal barrier island 16 to provide conductive cooling in between heating cycles.

FIG. 1 is not drawn to scale and is not representative of the thickness of layers or even the relative thickness of layers. Furthermore, FIG. 1 is not meant to be an accurate representation of all the layers used to form a thermal ink jet printhead. For example, the protective layer is frequently made up of more than 1 layer. In addition, the intermediate layer 22 or dielectric layer 24 may not be needed depending on the particular method used to form the printhead 10. FIG. 1 is a simplified layer representation that is used herein to illustrate the heat flow path 30 that is blocked or limited by the thermal barrier island 16 and the heat flow path 32 around the barrier island 16. The particular number of layers used in the ink jet printhead will depend on the particular method used to form the printhead. Several methods for forming thermal ink jet printheads which are the subject of this invention will be discussed with respect to FIGS. 3*a–g*, FIGS. 4*a–f*, FIGS. 5*a–f*, FIGS. 6*a–d* and FIGS. 7*a–d*. The thermal barrier island 16 can have a variety of shapes and sizes depending on the desired heat flow each of thermal paths 30 and 32. It is important that the barrier island 16 be positioned at least partially between the resistive heating element 14 and the substrate 12.

The thermal barrier 16 is made from a material having a thickness and lateral extent which is selected so that the heat flow through the thermal barrier 16 represented by arrow 30 is kept small thereby reducing the turn on energy. In addition the materials and geometry of the thermal path 32 is selected to provide sufficient heat flow so that the maximum frequency of the printhead 10 is high. Factors that effect the thermal path around the barrier island 16 represented by arrows 32 are the materials used in the first and second dielectric layers. 24 and 26, respectively and the material used in layer 22. In addition, the size or lateral extent of the barrier island 16 also effects amount of heat flow along of the path 32 around the thermal barrier island 16.

In one embodiment the barrier layer 16 is made from a porous material such as porous alumina or porous silicon. Porous materials, in general, have a lower diffusivity than similar non-porous materials. Some porous solids have an interconnected network which provides a circuitous path for phonon travel. If the pore size and the material is sufficiently porous then the circuitous path tends to result in scattering events which limits heat transport through porous solids. Other porous solids have more regular paths for phonon travel such as columns which are defined by straight or linear pores.

For porous solids the thermal diffusivity will be reduced by the porosity. For example a porous material that is 80% porous will have approximately ⅕ the thermal diffusivity of a similar non-porous solid, as the effective thermal conductivity is reduced by 80%. In the preferred embodiment the pores formed in the porous material are under vacuum thereby limiting the thermal transfer in the porous regions. Examples of the use of a porous thermal barrier island 16 will be discussed later with reference to FIGS. 3*a–g*, FIGS. 4*a–f*, and FIGS. 6*a–d*.

In yet another embodiment the thermal barrier island 16 is defined within or between one or more layers 22, 24, and the substrate portion 12. For this embodiment the thermal barrier island 16 is a cavity that may be filled with an inert gas at low pressure or evacuated forming a vacuum within the cavity. The use of an evacuated cavity as the thermal barrier island 16 provides a low thermal diffusivity path which provides an effective barrier for the thermal path from the heating element 14 to the substrate 12 along thermal path 30. Examples of the formation of an evacuated cavity for use as the thermal barrier island is discussed later with respect to FIGS. 7*a–g*. The evacuated cavity shown in FIGS. 7*a–g* is defined within by one or more layers between the substrate 12 and the heating element 14. Alternatively, the thermal barrier island 16 can be made from any conventional material which provides the desired thermal diffusivity.

In still another embodiment the thermal barrier island 16 positioned between the heating element 14 and the substrate portion 12 and having a plurality of thermal paths extending through the barrier island 16. An example of the use of the thermal barrier island 16 having a plurality of paths therethrough is shown in FIGS. 7*a*–g which will be discussed in more detail later.

The thermal barrier 16 of the present invention is used to tailor the heat flow from the heating element 14 to the substrate 12. The proper tailoring of underlayers between the heating element 14 and the substrate 12 prevents rapid dissipation of short duration energy pulses which are provided to the heating element 14 for bubble formation or nucleation while allowing sufficient dissipation of heat to maintain a low steady state operating temperature of the heating element 14. This tailoring involves reducing or eliminating heat flow to the substrate by way of thermal path 30 as well as providing the heat flow path 32 around the thermal isolation barrier 16 that provides sufficient heat flow to the substrate 12 for preventing the accumulation of heat in the printhead over a number of heating cycles. The thermal path 32 around the thermal barrier should be tailored such that a significant amount of heat does not flow from the heating element 14 during the heating period to maintain a low turn on energy. Therefore, a relatively low turn on energy is achieved while at the same time maintaining a high maximum frequency for the printhead.

Figure 2:
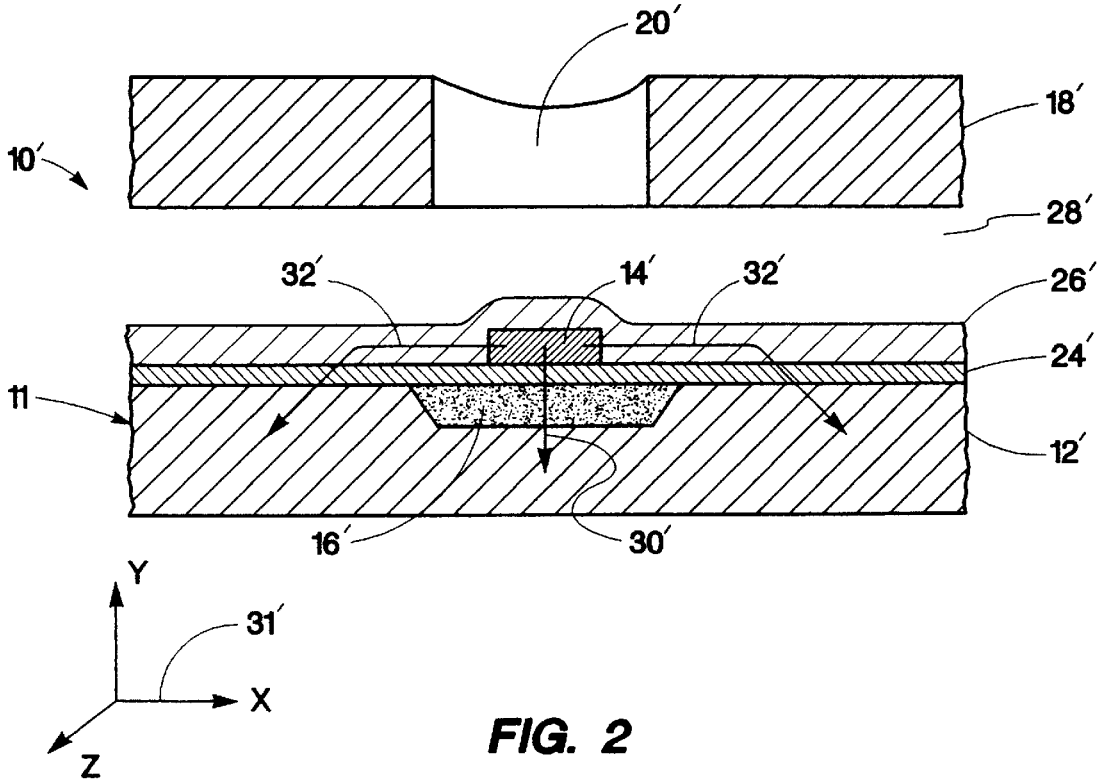
FIG. 2 shows a representation of a another embodiment of the thermal printhead shown in FIG. 1.

FIG. 2 shows a printhead 10' that is an alternative embodiment of the printhead 10 shown in FIG. 1. The printhead 10' shown in FIG. 2 is similar to the embodiment shown in FIG. 1 except that the thermal barrier island is defined at least partially within the substrate in contrast to FIG. 1 where the thermal barrier island 16 is formed on top of or above the substrate 12. Similar numbering will be used in FIG. 2 to identify structures that are similar to FIG. 1. FIG. 2 is a simplified layer diagram that is used to illustrate conductive heat flow between the heating element and the substrate portion. The layers drawn in FIG. 2 are not complete and are not drawn to scale. As discussed with respect to FIG. 1, the layers shown in FIG. 2 may not all be necessary. In addition some of the layers shown may actually represent more than one layer.

The printhead 10' includes a substrate 11 and a heating element 14'. The substrate 11 includes a substrate portion 12' and a thermal barrier island 16' positioned at least partially within the substrate 11. The thermal barrier island 16' is positioned between the heating element 14' and the substrate portion 12'. In contrast to the embodiment in FIG. 1, the thermal barrier island 16' in the embodiment of FIG. 2 is defined within the substrate 11 instead of on top of the substrate 12 shown FIG. 1. A first dielectric layer 24' is provided on the thermal barrier island as well as the substrate portion 12' to electrically isolate the thermal barrier island 16' from the heating element 14'. A second dielectric layer 26' covers the heating element 14' to prevent ink provided by an ink inlet 28' from damaging the heating element 14'. An orifice plate 18' having an orifice 20' is also included. The orifice plate 18' and orifice 20' are positioned proximate the heating element 14'. Electrical energy is provided to the heating element 14' by conductors (not shown) in a manner similar to the printhead 10 of FIG. 1. This electrical energy is converted to heat energy which produces nucleation or bubble formation for expelling ink droplets from the orifice 20'.

The thermal barrier island 16 limits heat flow between the heating element 14' and the substrate portion 12' in a vertical direction represented by the y-axis of coordinate system 31' and designated as path 30'. By preventing or limiting the heat flow between the heating element 14' and the substrate portion 12' along path 30' the turn on energy or energy required to produce drops of selected volume can be reduced in a manner similar to the printhead 10 of FIG. 1.

A second heat flow path is formed around the thermal barrier island 16' represented by an arrow 32'. This heat flow path is in both a lateral direction represented by the x and y-axis and in a vertical direction. represented by the z-axis of coordinate system 31'. The size of the thermal barrier island 16' defines the lateral extent of the heat flow path 32' in the second dielectric layer 26'. The size or lateral extent of the thermal barrier island 16', in part, defines the relative amount of heat flow along each path 30' and 32' between the heating element 14' and the substrate 12'.

Proper selection of dimensions and materials in heat flow paths 30 and 32 allows the thermal printhead 10' to be tailored to minimize the turn on energy and maximize the rate or frequency in which drops are produced in a manner similar to thermal printhead 10 shown in FIG. 1. The thermal barrier island 16' can be made from a variety of conventional materials having low thermal diffusivity. In one embodiment as will be discussed with respect to FIGS. 3*a–g* and 4*a–f* the substrate 11 is a silicon substrate that is etched to form a porous silicon portion which defines the thermal barrier island 16'. In another embodiment as will be discussed with respect to FIG. 5*a–f* the thermal barrier island 16' is a cavity defined within the substrate 11 and one or more layers defined on top of the substrate 11. This cavity may be filled with an inert gas at low pressure or more preferably a vacuum.

In the embodiment shown in FIGS. 1 and 2 the heating elements 14 and 14' are defined as a square piece of material. However the heating material may be a variety of different shapes. In addition, the barrier islands 16 and 16' will, in general, be larger than the heating elements 14 and 14'. However the size of the barrier island 16 and 16' is dependent on the desired heat flow for each of the heat flow paths 30, 30', 32 and 32'.

The printheads 10 and 10' shown in FIGS. 1 and 2 are shown partially broken away. In general, the printheads 10 and 10' have a plurality of heating elements with each of the plurality having each of a plurality of orifices 20 and 20', respectively, associated being therewith. The ink inlets 28 and 28' provide ink to the heating elements 14 and 14', respectively, in a conventional manner such as through the substrate 12 and 12' or from an edge of the substrate.

EMBODIMENT SHOWN IN FIGS. 3*a–g*

Figure 3A:
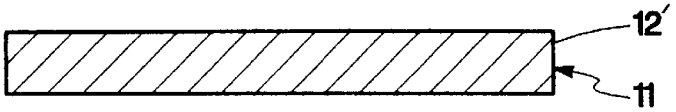
FIGS. 3*a–g* shows one method of the present invention for forming the barrier island thermal printhead shown in FIG. 2.

FIGS. 3*a–*3*g* show the method of the present invention for forming the printhead 10' shown in FIG. 2 having the thermal barrier island 16' defined within the substrate 11. The substrate 12' is a semiconductor that is lightly doped with P-type impurities using conventional techniques. FIGS. 3*a–*3*h* are not drawn to scale and are only for illustrating the process steps. Therefore, the thickness of each of the layers as well as the relative thickness of the different layers are not intended to be representative of the actual process for manufacturing the printhead 10' of the present invention.

Figure 3B:
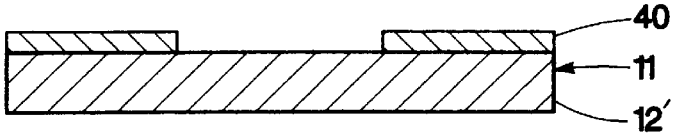
Figure 3C:
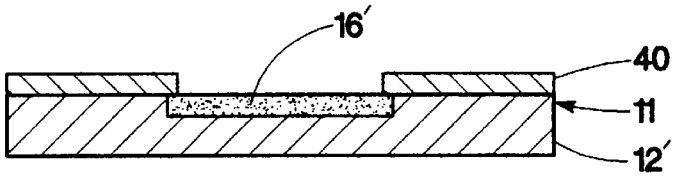

As shown in FIG. 3*b* a mask layer 40 is defined on the substrate 11. The mask layer 40 is used to define the thermal barrier island 16' shown in FIG. 2 using conventional photolithographic techniques. The mask layer 40 is made from a material that is resistant to an etchant used in a subsequent etching step. In one preferred embodiment the mask 40 is a dielectric material such as silicon nitride or silicon carbide that is deposited using conventional techniques such as Plasma Enhanced Chemical Vapor Deposition (PECVD), Chemical Vapor Deposition (CVD) or Physical Vapor Deposition (PVD).

The etch is applied to those areas of the substrate not covered by the mask 40 as shown in FIG. 3*b*. The etch selectively forms a porous silicon portion which acts as the thermal barrier island 16'. The etchant should be selected to provide a highly porous silicon interconnecting structure having thermal properties which provide for minimal heat flow between the heating element 14' and the substrate portion 12' along the thermal path designated 30' shown in FIG. 2. In one preferred embodiment the porous silicon portion has a porosity that is greater than 50%. In this preferred embodiment the etch process is an electrochemical process using a hydrofluoric etch which is selected to provide a small pore diameter and high porosity. In this preferred embodiment the pore diameter is in the range of 20 angstroms. The etchant is then removed from the silicon pores using a conventional method such a vacuum bake to remove any volatile etchant or etch products.

Figure 3D:
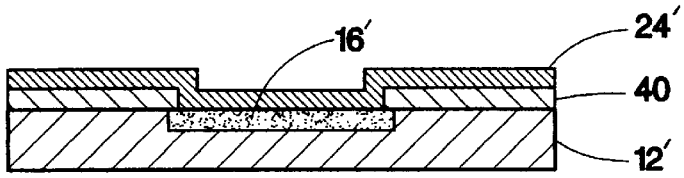

A dielectric layer 24' is then formed on the porous silicon layer 16' as shown in FIG. 3*d*. It is desirable that the pore size be small such that the dielectric layer 24' deposited over the porous silicon layer 16' is not deposited deep into the pores of the silicon. In one preferred embodiment the dielectric layer 24' is deposited using a physical deposition technique whereby the dielectric penetrates the pores no greater than a depth of tens of angstroms.

The dielectric layer 24' provides electrical isolation between the heating element 14' and the porous silicon 16'. Optionally, the mask layer 40 can be removed prior to depositing the dielectric layer 24'. The dielectric layer 24' should be as thin as possible to minimize the thermal mass of this layer. The greater the thermal mass of the dielectric layer 24' the greater the capacity of the dielectric layer 24' to store from the heating element 14' thereby increasing the turn on energy. In addition, making the dielectric layer very thin improves the heat flow around the thermal barrier island 16' to the substrate 12' which acts as a thermal sink, represented by thermal path 32' shown in FIG. 2. As discussed previously, improving the heat flow around the thermal barrier island 16' tends to produce low steady state operating temperatures and or high print frequencies.

In one preferred embodiment the dielectric layer 24' is a silicon dioxide layer that is 1000 to 3000 angstroms thick and formed using a conventional physical vapor deposition technique or a plasma enhanced chemical vapor deposition technique. It is important that the deposition not fill the pores in the silicon which would increase the porous silicon's ability to conduct heat as well as increase the ability of the porous silicon to store heat both of which are undesirable. Ideally, a vacuum in the silicon pores of the thermal barrier layer 16' is desired. Other conventional techniques such as a chemical vapor deposition can also be used to deposit the dielectric layer 24'.

Figure 3E:
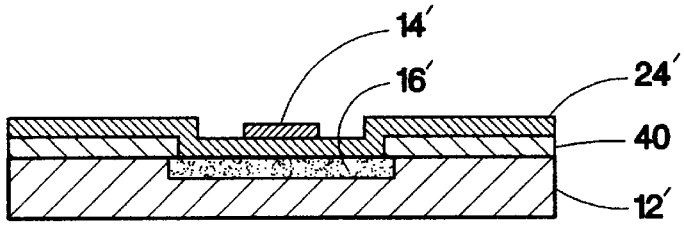
Figure 3F:
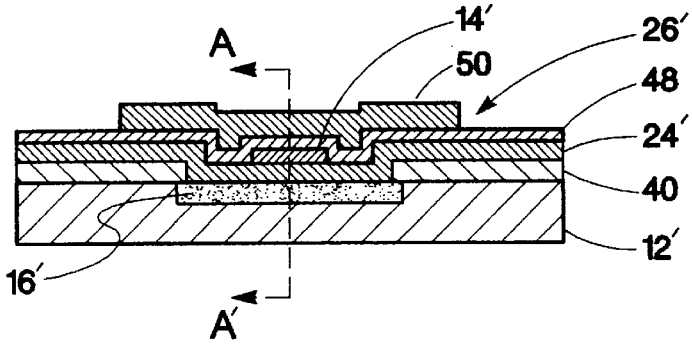
Figure 3G:
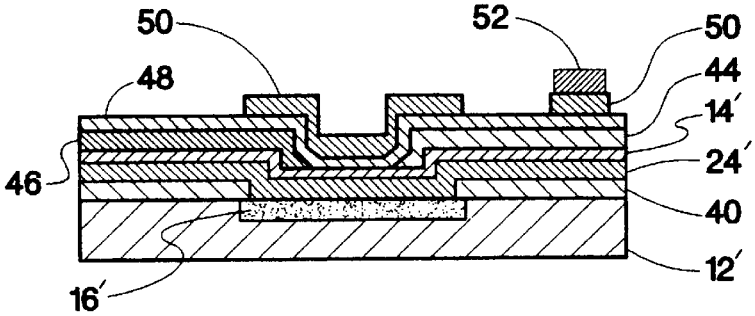

The remaining processing for forming the resistive heating element 14' and the second dielectric layer 26' or passivation layers shown in FIGS. 3*e*–3*g* is accomplished using conventional techniques such as those disclosed in U.S. Pat. No. 4,513,298 to Scheu and therefore will not be described in detail. As shown in FIG. 3*e* the resistive element 14' is formed on the dielectric layer 24'. The resistive element 14' is a conventional resistive material such as a doped semiconductor material. The resistive element 14' maybe formed by the diffusion of phosphors into a polycrystalline silicon layer or using oxide masking and diffusion techniques well known in the art of semiconductor processing. In one preferred embodiment the resistive element 14' is formed by sputtering an equal mixture of tantalum and aluminum.

Conductive elements 44 and 46 shown in FIG. 3*g* are formed for providing electrical energy to the heating element 14'. FIG. 3*g* is a sectional view of the printhead of FIG. 3*f* taken across lines A–A'. The conductive elements 44 and 46 may be formed of a conventional conductive material such as aluminum or aluminum and copper. These materials may be either sputtered onto the surface of the dielectric layer 24' or they may be formed using a vapor deposition technique which makes use of masking to permit the deposition to extend only over edge portions of the underlying resistive element 14'. As shown in FIG. 3*f* the heating element 14' is formed as layer, however, an active heater portion is only that portion that is between the electrical conductors 44 and 46. The active portion or heating element 14' is that portion of the resistive material which actively produces heat for bubble nucleation. The second dielectric layer 26' which includes a first and second passivation layer 48 and 50 respectively, are conventional passivation layers which protect the heating element 14' from chemically interacting with solvents in the ink as well as from cavitation stresses resulting from bubble collapse.

The passivation layers 48 and 50 provide a good heat flow path between the heating element 14' and ink to facilitate bubble nucleation. The first passivation layer 48 must be extremely hard to prevent cavitation damage which can potentially damage the heating element 14'. In one preferred embodiment the first passivation layer 48 is a silicon nitride layer that is formed by the plasma enhanced chemical vapor deposition of silicon nitride.

The second passivation layer 50 is then deposited on the first passivation layer 48. The second passivation layer which acts as an anticavitation layer is a conventional passivation layer such as tantalum. The second passivation layer 50 is applied using conventional deposition, patterning and etching. In addition, the second passivation layer 50 is deposited through vias to provide electrical connection to the conductive elements 44 and 46. The vias for connection to conductive elements 44 and 46 are not shown. A gold layer 52 is patterned and deposited in a conventional manner for providing electrical energy to the heating element 14' by way of the conductive elements 44, 46, tantalum layer 50 and gold layer 52.

The porous silicon portion 16' should be on the order of microns to tens of microns in thickness. The thickness of the porous layer 16' will vary depending on the material and type of porous structure formed in the etching process. The thickness of the porous structure 16' once the etching process is selected should be of sufficient depth to reduce heat flow to the substrate portion 12' to achieve the desired turn on energy.

EMBODIMENT SHOWN IN FIGS. 4 *a–f*

FIGS. 4*a*–4*f* show an alternative method of forming the thermal printhead 10' shown in FIG. 2. The thermal printhead 10' shown in FIGS. 4*a*–4*g* is for use with an aluminum substrate portion 12' instead of a silicon substrate as shown in FIGS. 3*a*–3*h*. Aluminum is an attractive substrate material particularly for very large thermal ink jet printheads required for page wide arrays. A page wide array is a thermal ink jet printhead or a plurality of thermal inkjet printheads which extend the entire width of the print media. Aluminum is an attractive substrate for page wide arrays because aluminum is inexpensive, easy to machine and an excellent thermal conductor. In contrast, silicon is very difficult and expensive to fabricate large substrates such as required in page wide array applications.

Figure 4A:
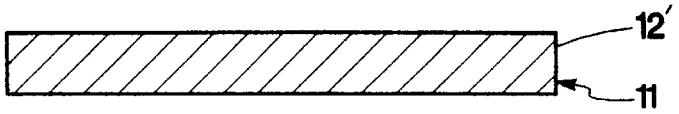
FIGS. 4*a–f* shows an alternative method for forming the barrier island thermal printhead shown in FIG. 2.
Figure 4B:
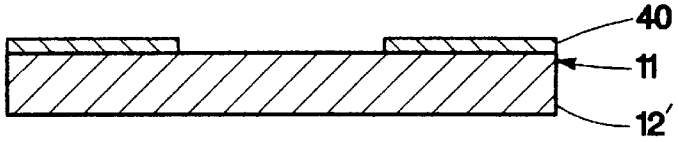
Figure 4C:
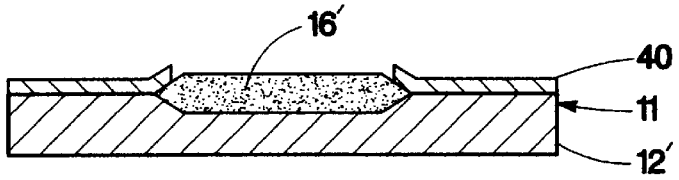
Figure 4D:
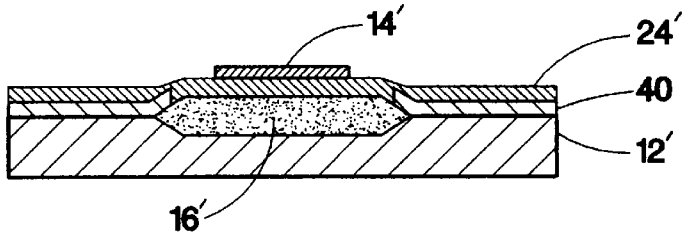
Figure 4E:
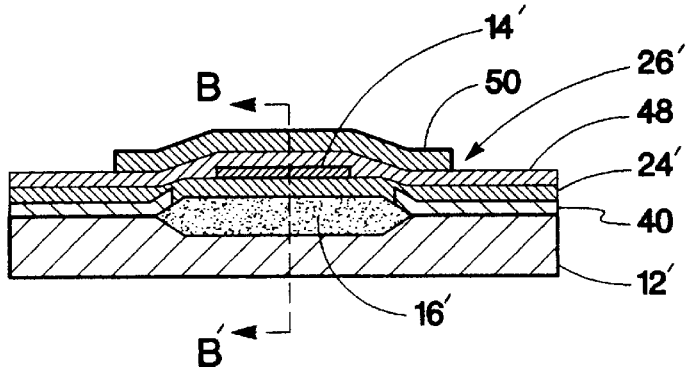

The fabrication of the alternative embodiment of the thermal ink jet printhead 10' shown in FIG. 2 has similar steps to the first alternative embodiment described in FIGS. 3*a*–3*g*. Therefore, similar structures in FIGS. 4*a*–4*f* will be identified using similar numbering to that of FIGS. 3*a*–3*g*. FIG. 4*a* shows an aluminum substrate 11. A hard mask 40 is deposited and patterned on the substrate portion 12' to define the thermal barrier region 16' as shown in FIG. 4*b*. The hard mask should be resistant to an etch used in subsequent anodizing steps. The top surface of the substrate 12' not covered by the mask 40 is anodized. This anodization is accomplished either by using an anodizing tank that is constructed so that only the top surface of the substrate 12' is exposed to solution. It can be seen from FIG. 4*c* that the anodizing process produces a volume expansion for the top surface of the substrate 12' which is exposed to the solution. For anodic oxidation of aluminum the volume expansion is on the order of 1.6. The expansion and lifting of the mask 40 is shown in FIGS. 4*c*–4*e*. This volume expansion should be controlled so that the mask 40 does not delaminate or lift from the substrate 12'. In addition, the pore size should be small and the porosity should be high as discussed previously with respect to FIGS. 3*a*–3*g*.

The oxidized or porous portion of the substrate 12' forms the thermal barrier region 16'. A thin dielectric layer 24' is then applied over the mask layer 40 the thermal barrier island 16' as shown in FIG. 4*d*. The dielectric layer 24' is very thin and serves to seal the porous alumina as well as provide electrical isolation for a heater element 14' which is defined on top of the dielectric layer 24'. The thermal barrier island 16' is positioned between the heater element 14' and the substrate 12' as shown in FIG. 4*d*.

Figure 4F:
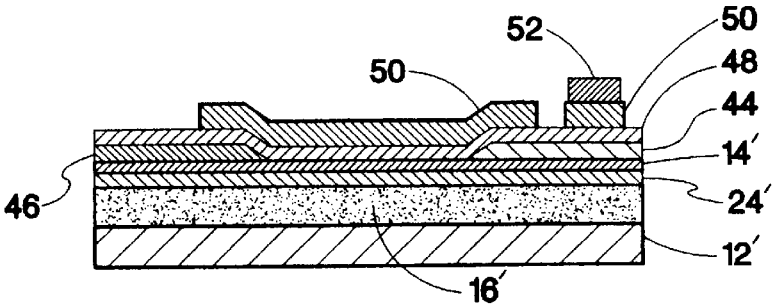

The heater element 14', conductive elements 44 and 46, conductive layer 52 and second dielectric layer 26' which includes first and second passivation layers 48 and 50 illustrated in FIGS. 4*d*, 4*e* and 4*f* are formed in a conventional manner such as described with respect to FIGS. 3*e*–3*g*. The heating element 14' is formed from a doped semiconductor material or a mixture of tantalum and aluminum. Conductive elements 44 and 46 are formed on the heating element 14'. The conductive elements 44 and 46 provide electrical energy to the heating element 14'. The conductive elements 44 and 46 may be formed from aluminum or aluminum and copper or any conventional conductive material. The first passivation layer 48 is applied over the conductive elements 44, 46, the first dielectric layer 24' and heating element 14'. The first passivation layer 48 protects the underlying layers from solvents in the ink as well as from damage resulting form cavitation. The first passivation layer 48 is etched to allow for connection or vias from the second passivation layer 50 to the conductive elements 44 and 46. The second passivation layer 50 is then deposited and patterned on the first passivation layer 48 using conventional techniques. The second passivation layer 50 provides electrical connection to the conductive elements 44 and 46. Conductive layer 52 is then patterned and applied in a conventional manner to provide electrical connection to vias in the passivation layer 48 as shown in FIG. 4*f* (vias not shown).

EMBODIMENT SHOWN IN FIGS. 5*a*–*f*

FIGS. 5*a*–5*f* illustrate another alternative embodiment for forming the thermal printhead 10' shown in FIG. 2 wherein the thermal barrier island is formed at least partially within the substrate 11. This embodiment shown in FIGS. 5*a*–5*f* makes use of a vacuum layer that is positioned between the substrate portion 12' and the heating element 14'.

Figure 5A:
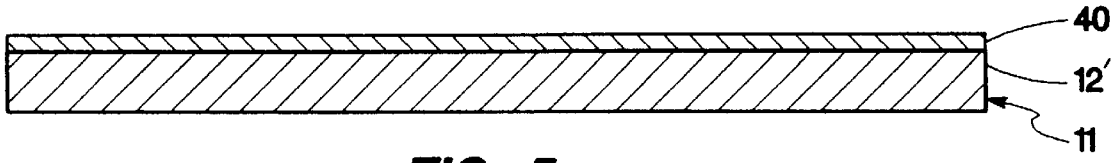
FIGS. 5*a–f* shows another alternative method for forming the barrier island thermal printhead shown in FIG. 2.
Figure 5B:
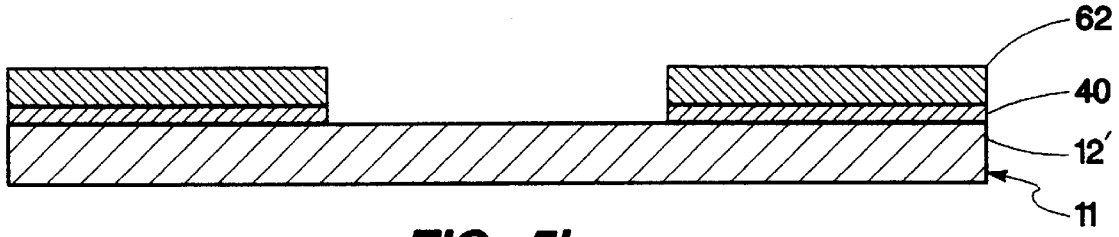
Figure 5C:
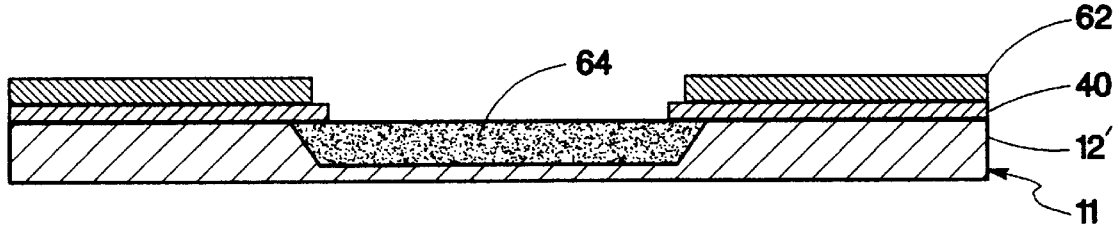

As shown in FIG. 5*a* a silicon substrate layer is lightly doped with P type impurities using a conventional techniques. A conventional mask layer 40 such as silicon nitride or silicon carbide is then deposited on the silicon substrate 11 using conventional deposition techniques. The mask layer 40 is selected to be resistant to a subsequent silicon etching process such as an electrochemical hydrofluoric etch. A pattern layer 62 is then deposited on the mask layer 40 to pattern the mask layer 40. The mask layer 40 is pattern etched to expose the substrate 11 as shown in FIG. 5*b*. An electrochemical etch is then used to form a porous silicon portion 64 within the silicon substrate 11 as shown in FIG. 5*c*.

Figure 5D:
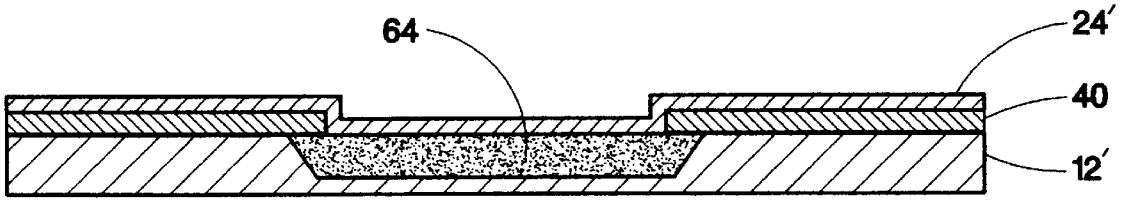

The substrate 11 includes the porous silicon portion 64 and a substrate portion 12'. In one preferred embodiment the electrochemical etch makes use of a hydrofluoric etch which is selected to have a concentration and a electrochemical current which is selected such that the pore diameter is small and the porosity is high. In this preferred embodiment the pore diameter is on the order of 20 angstroms. It is desirable that the pore size be small such that a dielectric layer 24' which is deposited over the porous silicon 64 is not deposited deep into the pores of the silicon as shown in FIG. 5*d*. In one preferred embodiment the dielectric layer 24' is deposited using a physical deposition technique whereby the dielectric penetrates the to a depth that is no greater than tens of angstroms.

Figure 5E:
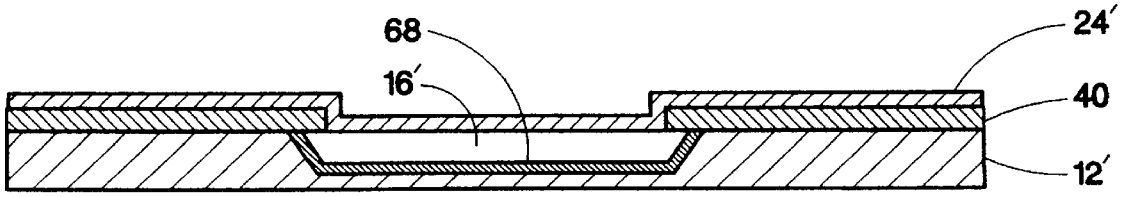

A laser is then used to irradiate the porous silicon portion 64 to melt the porous silicon as shown in FIG. 5*e*. The laser wavelength is selected such that the dielectric layer 24' absorbs little or no laser energy but instead allows the laser energy to pass through to the porous silicon portion 64. The laser is preferably a focused pulse laser which is selected to melt the porous silicon portion 64 which then slumps and recrystalizes forming a recrystalized silicon layer 68. The dielectric layer 24' is selected to have a melting point that is greater than the melting point of the porous silicon portion 64. As the porous silicon 64 melts and slumps the dielectric layer 24' remains forming a free standing film. The dielectric should be chosen so that the molten silicon does not wet and wick up onto the underside of the dielectric. The area of evacuated by the melted porous silicon forms a low pressure cavity which acts as a thermal barrier island 16' for reducing or eliminating heat flow between the heating element 14' and the substrate 12' along the thermal path 30' shown in FIG. 2. This thermal barrier 16' is a very low pressure region thereby acting as an excellent thermal barrier.

Figure 5F:
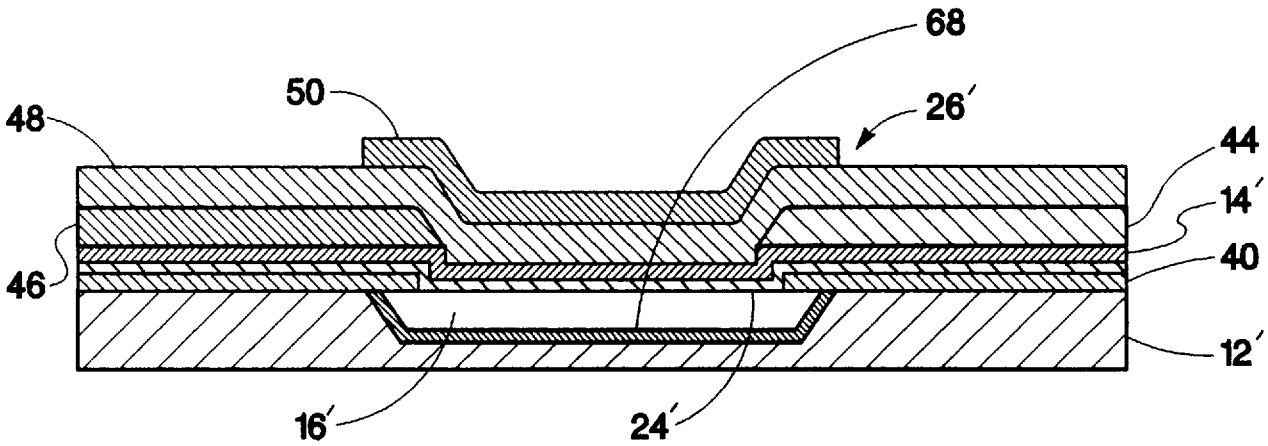

Once the thermal barrier island 16' is formed the remaining processing steps are performed to define the heating element 14', electrical interconnections and passivation layer 26' using conventional techniques as shown in FIG. 5*f*. As discussed previously with respect to FIGS. 3*e*–3*g* as well as FIGS. 4*d*–4*f* the resistive layer used to form the resistive heating element 14' is deposited using conventional techniques. Electrical conductors 44 and 46 are then deposited on the resistive layer to define the resistive heating element 14. The passivation layer 26' includes a first and second passivation layers 48 and 50, respectively. The first passivation layer 48 is deposited on the electrical conductors 44 and 46 as well as the heating element 14'. The second passivation layer 50 is deposited over the first passivation layer 48. Electrical interconnects (not shown) are then provided for providing electrical energy to the electrical conductors 44 and 46.

EMBODIMENT SHOWN IN FIGS. 6 *a*–*d*

FIGS. 6*a*–6*d* illustrate a method of forming the thermal printhead 10 shown in FIG. 1 wherein the thermal barrier island 16 is a porous material that is formed on top of the substrate portion 12. In contrast to the embodiments disclosed in FIGS. 3*a*–3*g*, FIGS. 4*a*–4*f*, and FIGS. 5*a*–5*f* which are similar to the invention of FIG. 2 in that the thermal barrier island is defined within the substrate, the embodiments that will now be described with respect to FIGS. 6*a*–6*d* and FIGS. 7*a*–7*g* are similar to the invention of FIG. 1 in that the thermal barrier island is formed on top of the substrate.

Figure 6A:
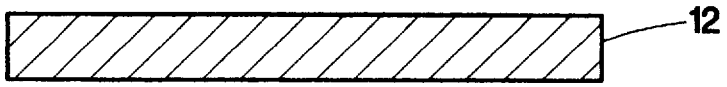
FIGS. 6*a–d* shows one method for forming the barrier island thermal printhead shown in FIG. 1.
Figure 6B:
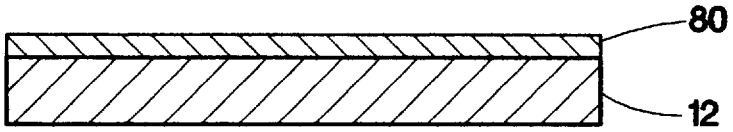
Figure 6C:
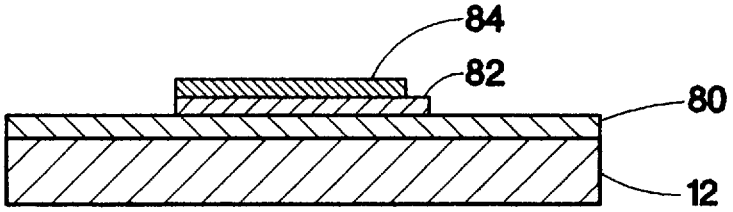

A suitable substrate portion 12 is provided as shown in FIG. 6*a*. In one preferred embodiment the substrate portion 12 is made from aluminum. A thin dielectric layer 80 is deposited on the surface of the substrate portion 12 in a conventional manner as shown in FIG. 6*b*. An aluminum thin film 82 is deposited and patterned on the dielectric 80 using conventional techniques. A dielectric layer 84 is then deposited and patterned over the thin film aluminum layer 82 using conventional techniques. The dielectric layer 84 covers the aluminum layer 82 except for a region that is exposed for electrical contact for use during anodization.

The thin film aluminum layer 82 is then anodized to form a porous alumina portion which functions as the thermal barrier island 16 as discussed in FIG. 1. A preferred technique for anodizing the aluminum layer 82 is to form a porous layer whereby the cell structure formed is oriented with an axis of elongation parallel with the surface of the substrate portion 12. A known method for forming a horizontal array of pores by anodic oxidation of aluminum is described in the article entitled "Fabrication Of A One Dimensional Micro Hole Array By Anodize Oxidization Of Aluminum" by Hideki Masuda, applied physics letter, Vol. 63, Number 23, Dec. 6, 1993, pp 3155–3157. This method makes use of an electrochemical etch process to oxidize an aluminum layer to form a porous alumina layer. The porous alumina layer 82 acts as the barrier island 16 shown in FIG. 6*d*. The heating element 14, conductive material 44 and 46, passivation layers 48 and 50, and interconnect layer 52 are then added in a conventional manner such as described with respect to FIGS. 3*e*–3*g* and FIGS. 4*d*–4*f* previously discussed.

Figure 6D:
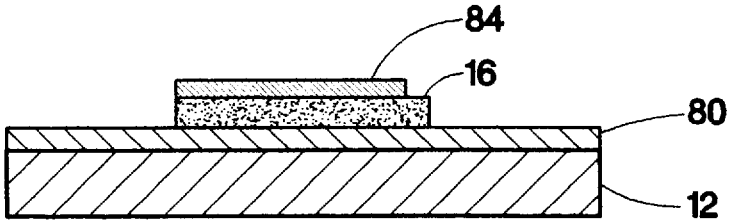

Alternatively, the thermal barrier island 16 shown in FIG. 6*d* can be formed using a process similar to the process shown in FIGS. 6*a*–6*d* except that instead of using a dielectric layer 84 to form a horizontal cell structure, as discussed previously, the aluminum layer 82 layer can be etched to form pores that have a vertical orientation or generally perpendicular to the substrate. One such electrochemical etch process is a conventional surface etch process which makes use of a sulfuric acid solution with an electrical bias applied. The porous alumina layer 82 results in pores running generally perpendicular to the substrate 12 which then forms the thermal barrier island 16. The porous alumina layer 82 or barrier island 16 is then cleaned and a thin dielectric layer (not shown) is deposited to plug the pores in the alumina and to provide electrical isolation from the aluminum substrate 12. As discussed previously with respect to porous silicon in FIGS. 3*d* and 4*d*, the dielectric layer should be thin to provide a thermal path around the thermal barrier island 16 that is sufficient to maintain a low steady state operating temperature and allow high print frequencies. The heating element 14, conductive material 44 and 46, passivation layers 48 and 50, and interconnect layer 52 are then added in a conventional manner such as described with respect to FIGS. 3*e*–3*g* and FIGS. 4*d*–4*f* previously discussed.

EMBODIMENT SHOWN IN FIGS. 7 *a*–*g*

FIGS. 7*a*–7*g* illustrate a method of forming the thermal printhead 10 shown in FIG. 1 wherein the thermal barrier island is formed on top of the substrate and positioned between the resistive heating element 14 and the substrate. In contrast to the embodiments previously described, the embodiment shown in FIGS. 7*a*–7*g* makes use of a thermal barrier island 16 having a plurality thermally conductive elements extending through the thermal barrier island 16. FIGS. 7*a*–7*g* are representations to illustrate the different layers used to form the thermal printhead 10 and are not drawn to scale.

Figure 7A:
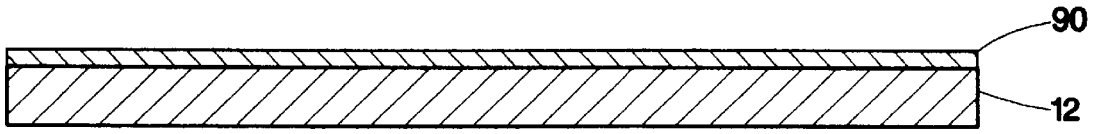
FIGS. 7*a–g* shows an alternative method for forming the barrier island thermal printhead shown in FIG. 1.
Figure 7B:
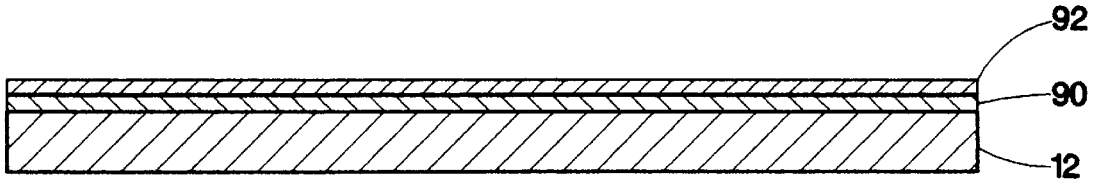
Figure 7C:
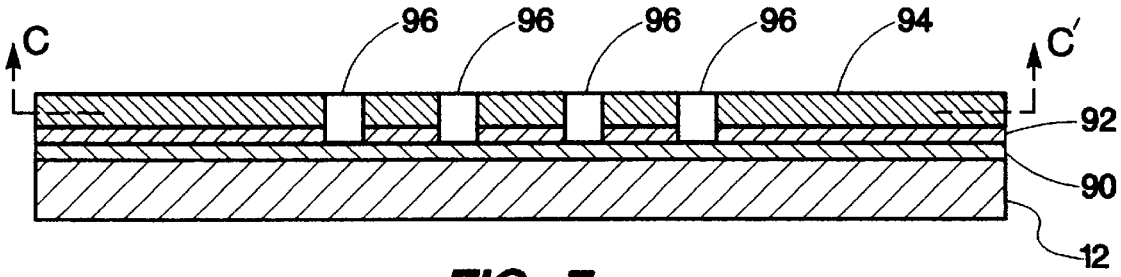

FIG. 7*a* shows a silicon substrate 12 on which a thin layer of thermal silicon dioxide 90 is grown in a conventional manner. Next, a dielectric layer 92 is deposited over the silicon dioxide layer 90 as shown in FIG. 7*b*. The dielectric layer 92 is selected to be resistant to an etch used in subsequent processing steps. As shown in FIG. 7*c* a pattern layer 94 is deposited over the dielectric layer 92. It is preferable that the dielectric layer is made from silicon nitride. The pattern layer 94 is preferably a photo resist layer that is used in conjunction with a dry etch for defining holes in the silicon nitride dielectric layer 92. An etch is then used to remove portions of the silicon dioxide layer 90, undercutting the silicon nitride. In the preferred embodiment the etchant is hydrofluoric acid.

Figure 7D:
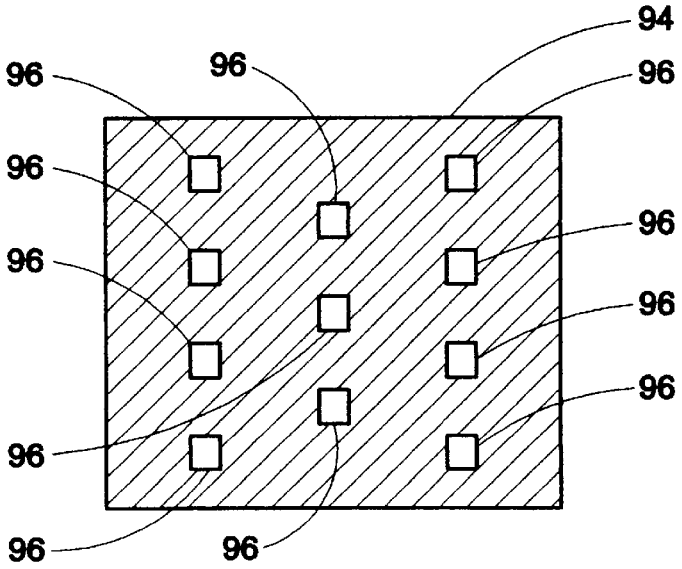
Figure 7E:
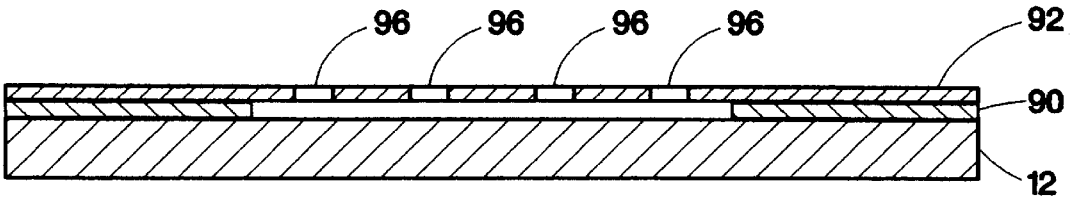
Figure 7F:
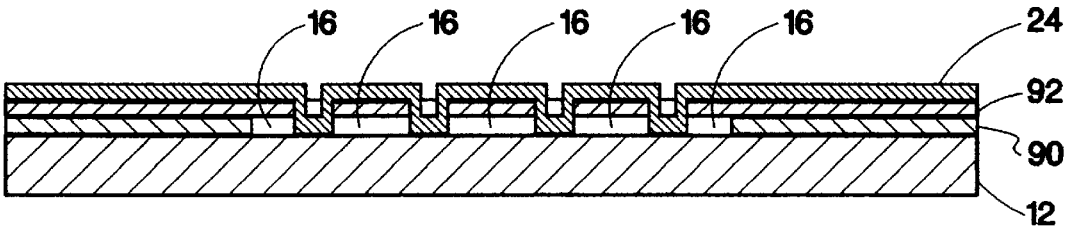

FIG. 7*d* shows a top plan view of the photo resist pattern layer 94 of FIG. 7*c*. It can be seen from FIG. 7*c* that the holes 96 opened up in the pattern layer 94 are spaced laterally in two dimensions. After the etch is applied to remove portions of the silicon dioxide layer 90 a free standing film 92 as shown in FIG. 7*e* is formed. A conventional physical vapor deposition technique is used to apply a second dielectric 98 to fill the etch holes 96 in the silicon carbide layer 92. As shown in FIG. 7*f*. Those portions not filled by the second dielectric 98 define a void or vacuum region representing the thermal barrier 16.

Figure 7G:
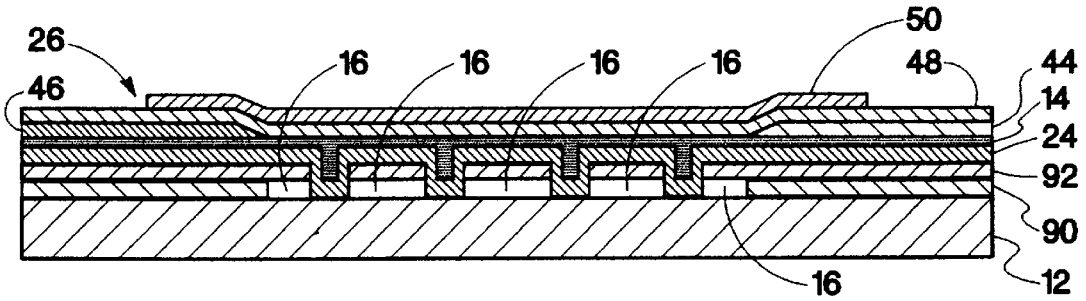

As shown in FIG. 7*g* a resistive heating element 14' as well as electrical interconnects 44 and 46, and a passivation layer are defined using conventional techniques similar to those disclosed previously with respect to FIGS. 3*e*–3*g*, and FIGS. 4*e*–4*f*. The passivaton layer 26 includes a first and second passivation layer 48 and 50, respectively. The final processing steps include depositing an interconnect layer 52 (not shown).

The thermal barrier island 16 that is formed in the embodiment described with respect to FIGS. 7*a*–7*g* has a series thermal conductors extending therethrough. In the preferred embodiment shown in FIGS. 7*a*–7*g* the thermal conductors are columns of the dielectric material 98 which extend through the barrier island 16 as shown in FIG. 1. The columns or beams of dielectric material 98 seal the void and provide mechanical support for the cavity structure which forms the barrier island 16. This mechanical support helps to protect the barrier island from stress due to cavitation. These columns can conduct heat. Therefore, the number of columns formed will depend on the tradeoff between thermal impedance of the barrier island 16 and the mechanical support required to protect the barrier island 16 from stresses such as cavitation stresses. The thermal barrier island 16 should be sized and positioned such that the heat flow between the heating element 14 through the columns is sufficiently small such that the turn on energy is kept low. In addition, the dielectric layer 24 should be sufficiently thin so that the heat flow around the thermal barrier island 16 to the substrate 12 represented by the thermal path 32 shown in FIG. 1 is sufficiently large to maintain low steady state printhead temperatures, or alternatively, high print frequencies.

What is claimed is:

1. A method for forming an ink jet printhead for use in ink jet printing, the method comprising:

defining a substrate portion;

defining a thermal barrier island, the defining a thermal barrier island including:

depositing a first planar layer on the substrate portion depositing a second planar layer on the first planar layer; and displacing at least a portion of the first planar layer beneath the second planar layer to define a free standing film, wherein the thermal barrier being defined by a cavity between the free standing film and the substrate; and defining a resistive heating element for ejecting ink from the printhead, the thermal barrier island being disposed between the substrate portion and the resistive heating element.

2. The method of claim 1 wherein displacing at least a portion of the first layer comprises selectively etching the first layer to remove at least a portion of the first layer.

3. The method of claim 2 wherein selectively etching is accomplished by an electrochemical etching process.

4. The method of claim 1 wherein displacing at least a portion of the first layer comprise heating a portion of the first layer.

5. The method of claim 1 further including:

defining a dielectric layer on the free standing film wherein the resistive heating element is defined on the dielectric layer with the porous material being positioned between the substrate portion and the resistive heating element.

6. The method of claim 5 further including defining an ink ejection orifice proximate the resistive heating element.

* * * * *